US008020506B2

(12) United States Patent
Wang

(10) Patent No.: US 8,020,506 B2
(45) Date of Patent: Sep. 20, 2011

(54) DOUBLE LEVEL FLIGHT DECK TYPE AIRCRAFT CARRIER

(76) Inventor: Hsu-Cheng Wang, Taipei (TW)

( * ) Notice: Subject to any disclaimer, the term of this patent is extended or adjusted under 35 U.S.C. 154(b) by 206 days.

(21) Appl. No.: 12/453,699

(22) Filed: May 20, 2009

(65) Prior Publication Data

US 2010/0294188 A1 Nov. 25, 2010

(51) Int. Cl.
*B63B 35/50* (2006.01)

(52) U.S. Cl. ..... 114/261

(58) Field of Classification Search ..... 114/258, 114/261

See application file for complete search history.

(56) References Cited

U.S. PATENT DOCUMENTS 2,381,583 A * 8/1945 Fechtenburg ..... 114/261
3,000,343 A * 9/1961 Winter ..... 114/261
4,325,317 A * 4/1982 Wilford ..... 114/261

* cited by examiner

*Primary Examiner* — Daniel Venne
(74) *Attorney, Agent, or Firm* — Rosenberg, Klein & Lee

(57) ABSTRACT

A double level flight deck type aircraft carrier is disclosed to include a second level of flight deck so that aircraft launching and landing operations can be separately performed on the decks. The double deck design doubles the operation capacity and capability.

3 Claims, 6 Drawing Sheets

DOUBLE LEVEL FLIGHT DECK TYPE AIRCRAFT CARRIER

BACKGROUND OF THE INVENTION

1. Field of the Invention

The present invention relates to aircraft carrier technology and more particularly, to a double level flight deck type aircraft carrier that provides two level of flight decks for aircraft launching and landing operations separately.

2. Description of the Related Art

A conventional aircraft carrier 5, as shown in FIGS. 7 and 8, simply has one single flight deck 51 for the operations of aircraft A launching and landing. Because the flight deck 51 has a very limited space and a short runway, it is very crowed and dangerous to let a number of aircrafts perform launching and landing operations on this single flight deck 51. An accident may happen when aircrafts are landing on the flight deck one after another within a short interval. To improve this problem, the Navy needs to build larger aircraft carriers that provide a relatively greater runway for aircrafts. In consequence, the aircraft carrier construction cost is getting higher. Further, the aircraft elevator platforms 53 of the conventional aircraft carrier 5 are a part of the flight deck 51. When one aircraft elevator platform 53 of the flight deck 51 is lowered to carry the landed aircraft A to the bottom hanger deck 52, a dangerous opening is left on the flight deck 51 above the respective aircraft elevator platform 53.

SUMMARY OF THE INVENTION

The present invention has been accomplished under the circumstances in view. It is one object of the present invention to provide an aircraft carrier, which provides a second level flight deck to double the aircraft capacity and operation capability so that aircraft launching and landing operations can be performed on the two level flight decks separately.

It is another object of the present invention to provide a double level flight deck type aircraft carrier, which is equipped with a runway buffer device to buffer aircraft landing speed on a short distance section, assuring safer landing condition.

It is still another object of the present invention to provide a double level flight deck type aircraft carrier, which is equipped with extended aircraft elevator platforms, thereby increasing deck space and enhancing operation safety.

It is still another object of the present invention to provide a double level flight deck type aircraft carrier, which is has stabilizer fins provided at both sides of the ship hub to stabilize navigation.

DETAILED DESCRIPTION OF THE PREFERRED EMBODIMENT

Referring to FIG. 1~4, a double level flight deck type aircraft carrier 1 in accordance with the present invention is shown comprising a first level flight deck 11 and a second level flight deck 12 spaced above the first level flight deck 11. Aircraft A launching and landing operations is performed on the first level flight deck 11 and the second level flight deck 12 separately, assuring higher safety. Further, the added flight deck (the second level flight deck) can nearly doubles the aircraft capacity and operation capability. The construction of this second flight deck 12 may simply needs about extra 15~20% of the cost while the aircraft capacity and operation capability are doubled. The second flight deck 12 is almost the same as the first flight deck 11 (the conventional single flight deck). The added second flight deck 12 can be used for aircraft launching operation as well as aircraft landing operation. When no any aircraft is to be landing, both the first flight deck 11 and the second flight deck 12 can be used for aircraft launching. Thus, aircrafts A can be launched from the aircraft carrier 1 faster, raising the operation capability of the aircraft carrier 1.

Figure 1:
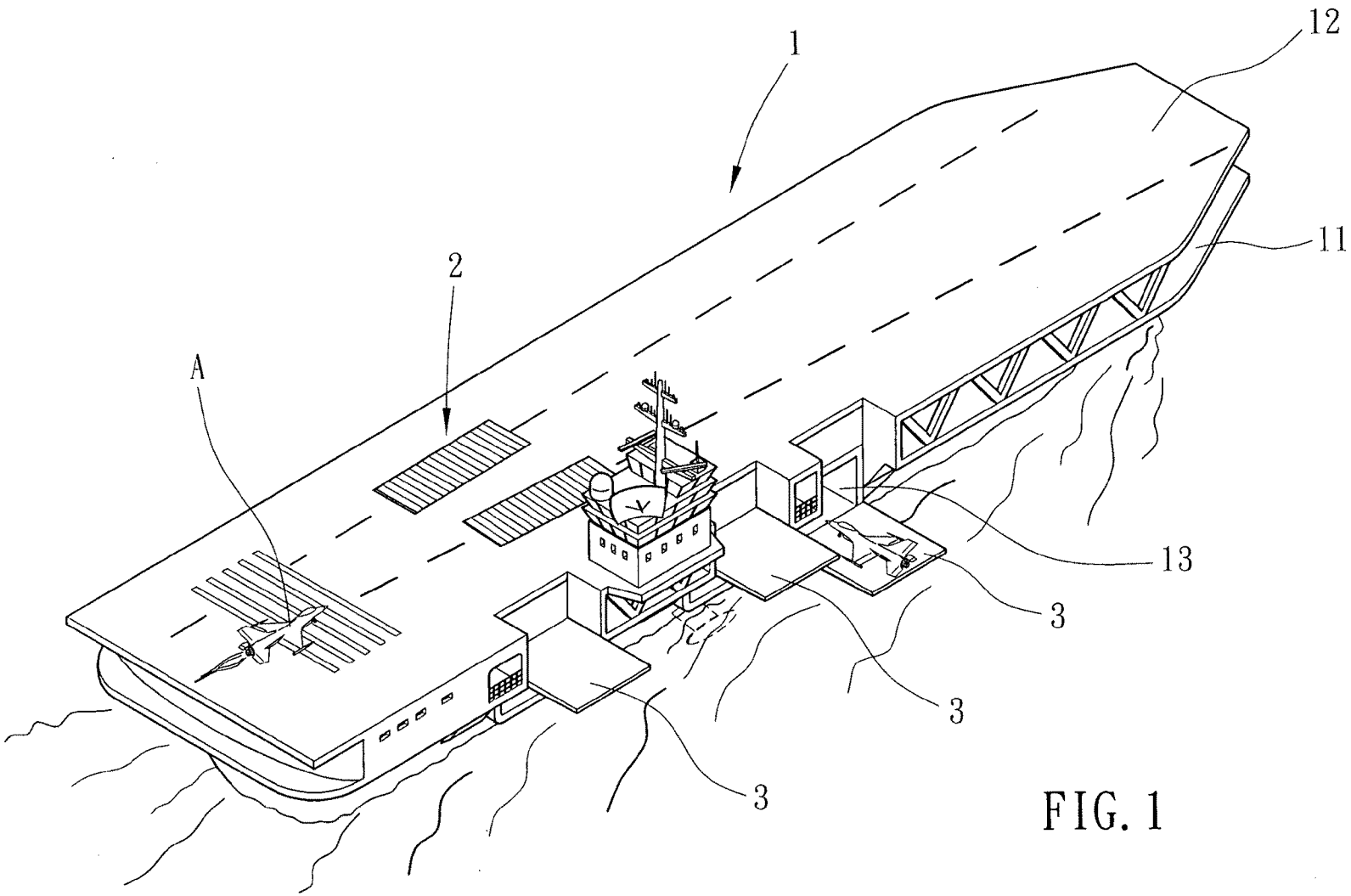
FIG. 1 is a schematic elevation view of a double level flight deck type aircraft carrier in accordance with the present invention.
Figure 2:
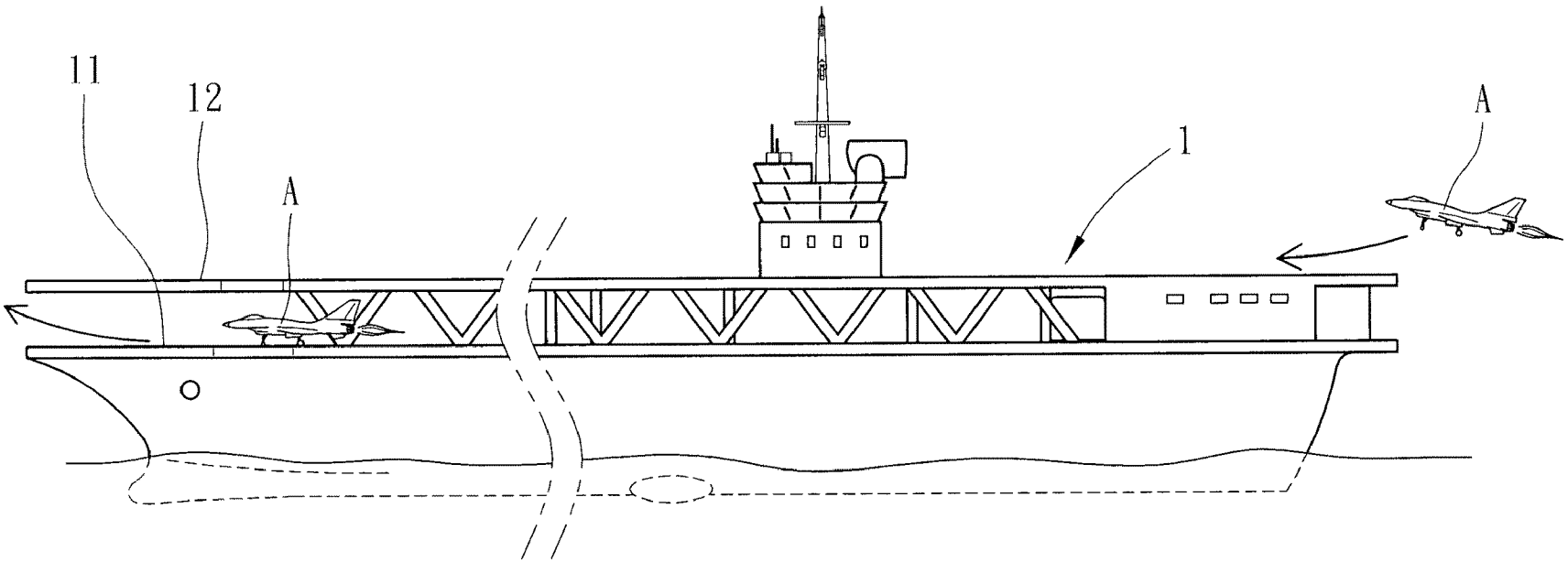
FIG. 2 is a schematic side view of the double level flight deck type aircraft carrier in accordance with the present invention.
Figure 3:
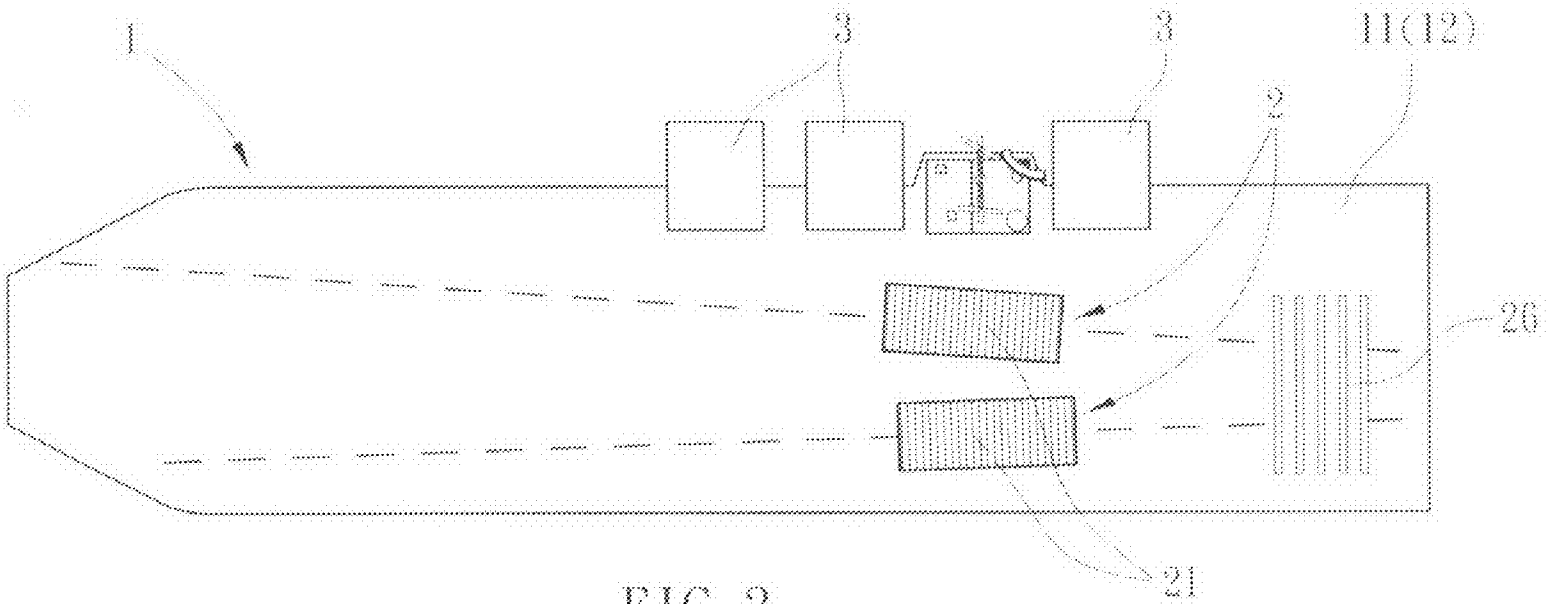
FIG. 3 is a schematic top view of the double level flight deck type aircraft carrier in accordance with the present invention.
Figure 4:
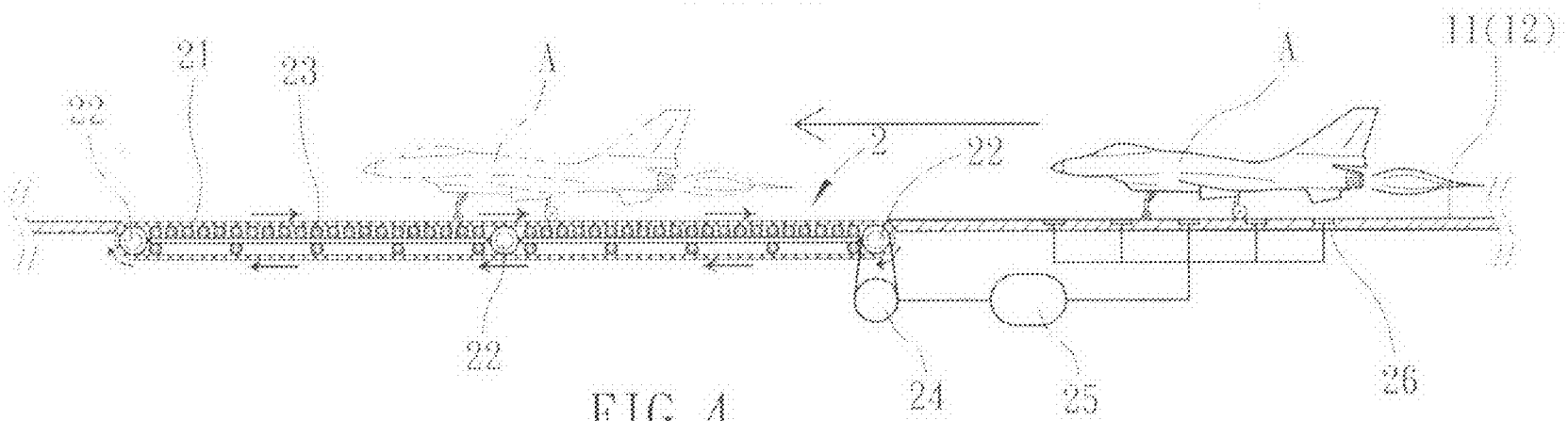
FIG. 4 is a schematic drawing of the present invention, showing the buffer effect of the runway buffer device upon landing of an aircraft on the flight deck.
Figure 6:
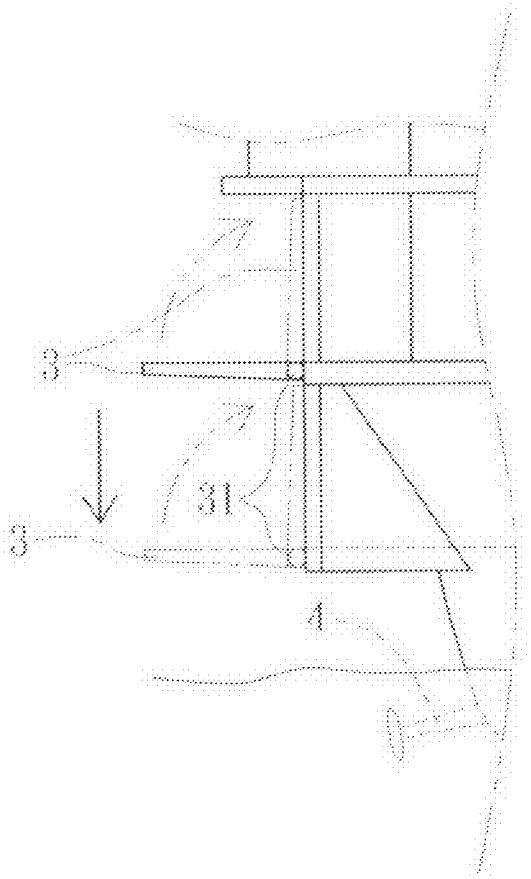
FIG. 6 is a schematic drawing of the present invention, showing the folding design of the extended aircraft elevator platform.

Further, runway buffer devices 2 are installed in the first flight deck 11 and the second flight deck 12 to buffer aircraft landing and launching speed. Further, extended first and second aircraft elevator platforms 3 are provided at edge side of the first flight deck 11 and the second flight deck 12, and adapted to carry each landed aircraft A to the bottom hanger deck 13 of the aircraft carrier 1 (see FIGS. 1 and 5). The extended aircraft elevator platforms 3 are folding collapsible. When not used or when the weather is not suitable for aircraft launching and landing, the extended aircraft elevator platforms 3 can be folded up, assuring safety (see FIG. 6).

The aforesaid runway buffer devices 2 each comprise a conveyor 21, a plurality of supporting rollers 22, a plurality of driven rollers 23, a plurality of driving motors 24, a control system 25 and a plurality of speed sensors 26. When an aircraft A is landing on the second flight deck 12, the speed sensors 26 detect the landing speed of the aircraft A and send a detection signal to the control system 25 so that the control system 25 control the driving motors 24 to rotate the driving rollers 23 at speeds subject the detection of the speed sensors 26. When the aircraft A reaches the conveyor 21, the conveyor 21 is moved in direction reversed to the landing direction of the aircraft A, thereby buffering the landing speed of the aircraft A. By means of the buffer effect of the runway buffer devices 2, the length of the second flight deck 12 can be minimized.

Figure 5:
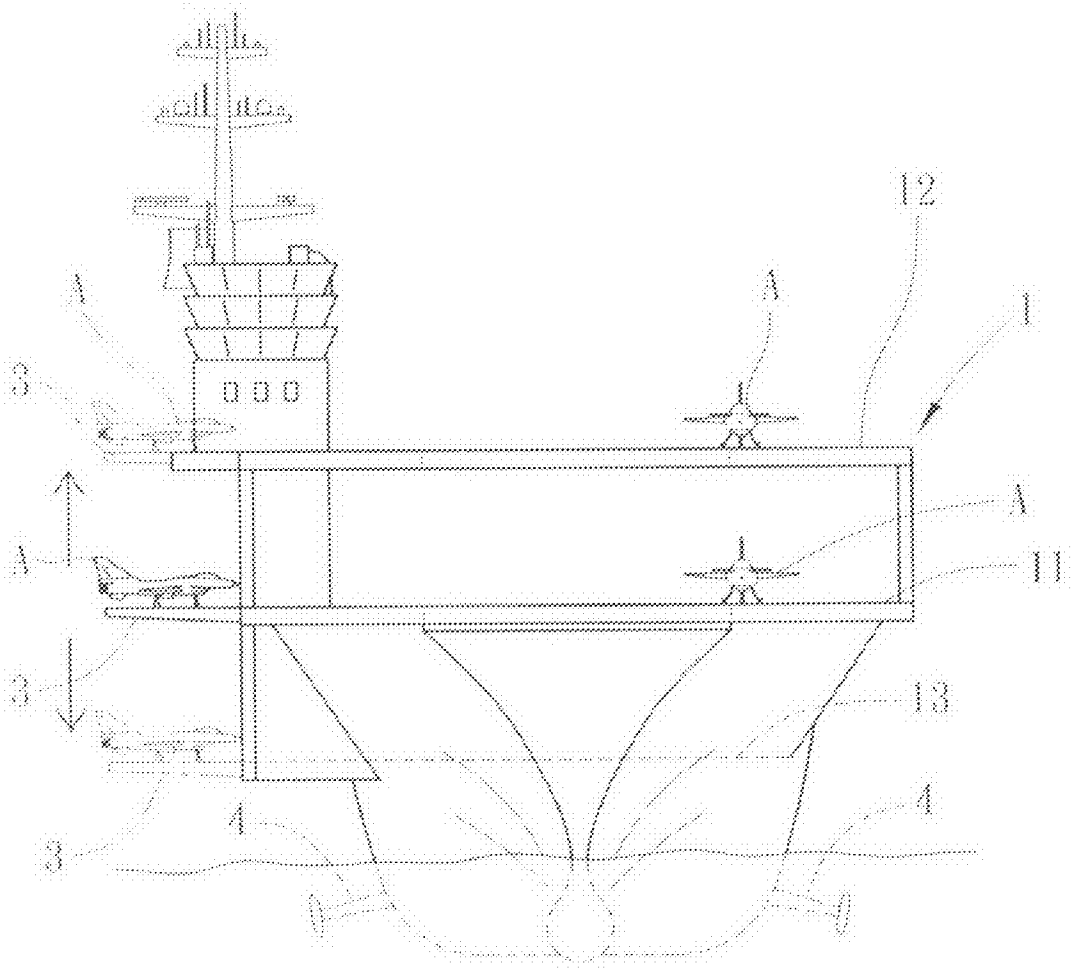
FIG. 5 is a schematic drawing of the present invention, showing the arrangement of one extended aircraft elevator platform.
Figure 7:
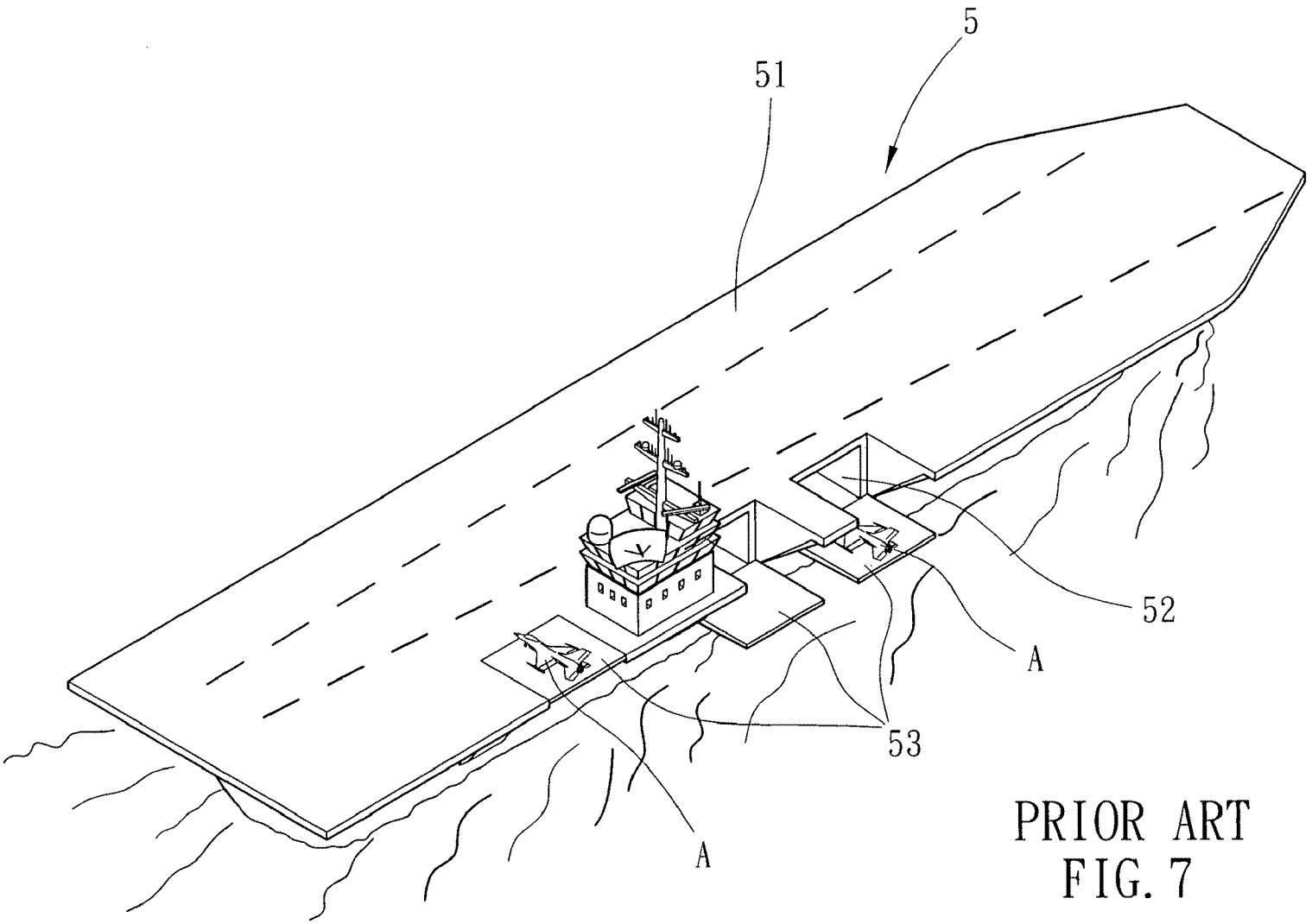
PRIOR ART FIG. 7
FIG. 7 is an oblique elevation of a conventional single level flight deck type aircraft carrier.
Figure 8:
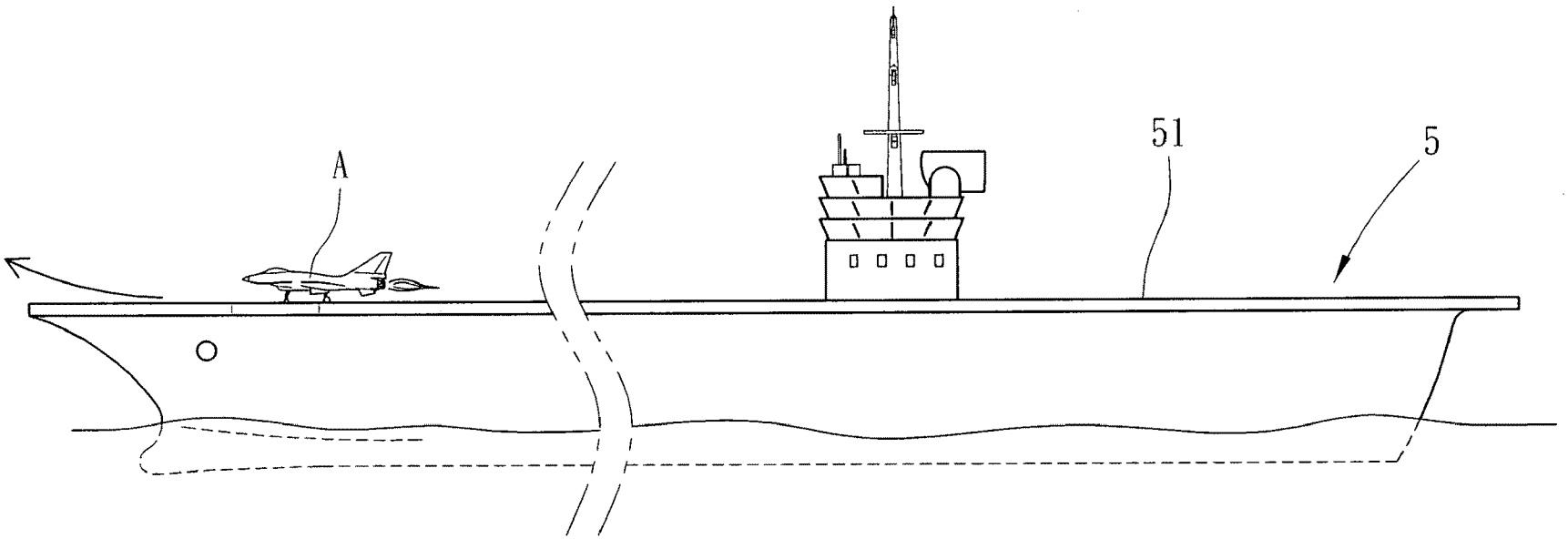
PRIOR ART FIG. 8
FIG. 8 is a side view of the conventional single level flight deck type aircraft carrier.

Further, a stabilizer 4 is installed in both sides of the ship hub of the aircraft carrier 1 near the bottom to stabilize navigation (see FIG. 5) . Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An aircraft carrier having a second level flight deck spaced above a first level flight deck and a second aircraft elevator platform outward from said second level flight deck and spaced above a first aircraft elevator platform at an outer side of said first level flight deck; and, a runway buffer device mounted on said second level flight deck for reducing a required runway landing distance for aircraft, said runway buffer device including a conveyor, a plurality of rollers, a plurality of driving rollers for linearly displacing said conveyor, a control system, and an aircraft speed sensor;

said runway buffer device being activated by said control system to displace the conveyor in an opposite direction to a landing direction of an aircraft when said aircraft is landing on said second level flight deck, said speed sensor for sending a signal to said control system or to the speed of said aircraft landing on said second level flight deck, said control system being coupled to said rollers and driving rollers for rotation of said driving rollers and rollers and responsively driving said conveyor for buffering a forward landing speed of said aircraft responsive to the speed of said aircraft detected by the sensor.

2. The aircraft carrier as claimed in claim 1, further comprising a stabilizer device located on each of two sides of a hub near a bottom of the hub.

3. The aircraft carrier as claimed in claim 1, said extended aircraft elevator platform is foldable.

* * * * *